US006057070A

United States Patent [19]

Ogura

[11] Patent Number: 6,057,070

[45] Date of Patent: May 2, 2000

[54] METHOD FOR FORMING A COLOR IMAGE

[75] Inventor: Motohiro Ogura, Odawara, Japan

[73] Assignee: Canon Kabushiki Kaisha

[21] Appl. No.: 09/010,344

[22] Filed: Jan. 21, 1998

[30] Foreign Application Priority Data

Jan. 21, 1997 [JP] Japan ..... 9-008912

[51] Int. Cl.[7] ..... G03G 13/01; G03G 13/16

[52] U.S. Cl. ..... 430/47; 430/126

[58] Field of Search ..... 430/47, 126

[56] References Cited

U.S. PATENT DOCUMENTS

| | | | |
|---|---|---|---|
| 3,758,327 | 9/1973 | York et al. | 430/126 |
| 4,259,422 | 3/1981 | Davidson et al. | 430/126 |
| 4,292,120 | 9/1981 | Nacci | 430/126 |
| 5,108,865 | 4/1992 | Zwaldo et al. | 430/126 |
| 5,458,954 | 10/1995 | Ogi et al. | 428/195 |
| 5,761,594 | 6/1998 | Seto et al. | 399/302 |

*Primary Examiner*—Roland Martin
*Attorney, Agent, or Firm*—Fitzpatrick, Cella, Harper & Scinto

[57] ABSTRACT

A method for forming an image is provided, in which a failure in transfer during image retransfer and peeling of toner are prevented, and a sufficiently excellent image is formed on a retransfer medium. In this method for forming an image, in which an image transferred onto a transfer material, having a polyvinyl-alcohol layer formed on a supporting member, according to an electrophotographic method is first fixed, and is again transferred onto a transfer medium, a resin layer having a surface tension, which is closer to a surface tension of a binding resin of a toner to be fixed than a surface tension of polyvinyl alcohol, is provided on a surface of the transfer medium.

9 Claims, 1 Drawing Sheet

METHOD FOR FORMING A COLOR IMAGE

BACKGROUND OF THE INVENTION

1. Field of the Invention

The present invention relates to a method for forming a color image. In this method, an image obtained in an image forming apparatus using charged particles, such as an electrophotographic apparatus, an electrostatic recording apparatus or the like, can be retransferred onto a final transfer material.

2. Description of the Related Art

Methods for transferring an image onto a three-dimensional object using a technique called image transfer have been widely known. For example, a hydraulic transfer method has been widely known. In this method, a water-soluble paste, such as dextrin or the like, is coated on a base material, such as paper or the like, and a required image is formed according to screen printing or the like on the coated film using acrylic ink. The paper having the image is soaked in water to dissolve dextrin, and the acrylic-ink image floating on water is transferred onto a three-dimensional object made of earthenware or the like. A case of directly applying a transfer material used in this method to electrophotography is also known. This transfer material comprises rice paper having a dextrin film formed thereon. After forming a toner image on the surface of the dextrin film by an electrophotographic apparatus, the transfer material is passed through an organic solvent capable of softening a resin within the toner, to provide the toner image with an adhesive force to a retransfer medium where the image is to be retransferred. Then, the toner image on the transfer material is brought in close contact with the retransfer medium, and water is supplied from the back side of the transfer material to dissolve the dextrin film, and to transfer only the toner image.

In such a transfer material comprising opaque paper having a water-soluble coated film formed thereon, it is difficult to perform alignment during image retransfer. In addition, the surface of the transfer material softens before forming the image due to moisture in the surrounding atmosphere, and the softened dextrin adheres to a photosensitive drum and the like within the electrophotographic apparatus. Furthermore, since the transfer material is sensitive to moisture in air as described above, the amount of expansion and contraction depending on the amount of moisture is large, thereby producing unnecessary shelf curling of the transfer material, and greatly degrading the property of passing/conveying paper within the apparatus.

In order to solve the above-described two problems, in Japanese Patent Laid-Open Application (Kokai) No. 4-361086 (1992), there is a proposal of a transfer material in which polyvinyl alcohol obtained by saponifying vinyl acetate is used instead of dextrin. The proposed transfer material is obtained by coating a silicone resin on paper, and coating a mixture of Kasesol O-5 (the name of a product made by Nikka Kagaku Kabushiki Kaisha) and a silicone antifoaming agent on the coated resin. In image retransfer, after forming a toner image on the coated film by an electrophotographic apparatus, the Kasesol film is stripped off from the base material, and the toner image on the coated film is brought in close contact with a retransfer medium.

Then, by providing heat and pressure, the resin within the toner image is softened to provide an adhesive force to the retransfer medium. After cooling the combined member comprising the transfer material and the retransfer member, an 80% aqueous solution of ethyl alcohol is supplied from the back side of the Kasesol film to reduce the adhesive force between the Kasesol film and the toner image, and to complete image retransfer.

According to this method, since the thin film having the toner image is stripped off from the base material, a substantially transparent film is obtained, so that alignment becomes easier.

In the above-described conventional approach, however, when the retransfer member is made of a material which has poor compatibility with toner, for example, metal, earthenware such as a tile or the like, or glass, it is very difficult to supply heat and pressure during image retransfer, resulting in a poor retransfer property such that, for example, it is difficult to transfer toner onto the retransfer medium, and toner after image retransfer tends to be easily removed. As a result, a sufficient retransferred image cannot be obtained.

SUMMARY OF THE INVENTION

The present invention has been made in consideration of the above-described problems.

It is an object of the present invention to provide a method for forming an image, in which a failure in transfer during image retransfer and peeling of toner are prevented, and a sufficiently excellent color image is formed on a retransfer medium.

According to one aspect, the present invention which achieves the above-described object relates to an image retransfer method comprising:

(a) transferring a toner image to a transfer material, said transfer material comprising a polyvinyl alcohol layer formed on a supporting member;

(b) fixing said transferred toner image; and (c) retransferring the transferred toner image onto a transfer medium, said transfer medium having on a surface thereof a resin layer having a surface tension which is closer to a surface tension of a binding resin of a toner forming said toner image than a surface tension of polyvinyl alcohol forming said polyvinyl alcohol layer.

In the present invention, by providing the resin layer which is compatible with the toner on the surface of the transfer medium, a failure in transfer during image retransfer and peeling of the toner are prevented, so that a sufficiently excellent image is formed on the transfer medium.

DESCRIPTION OF THE PREFERRED EMBODIMENTS

Figure 1:
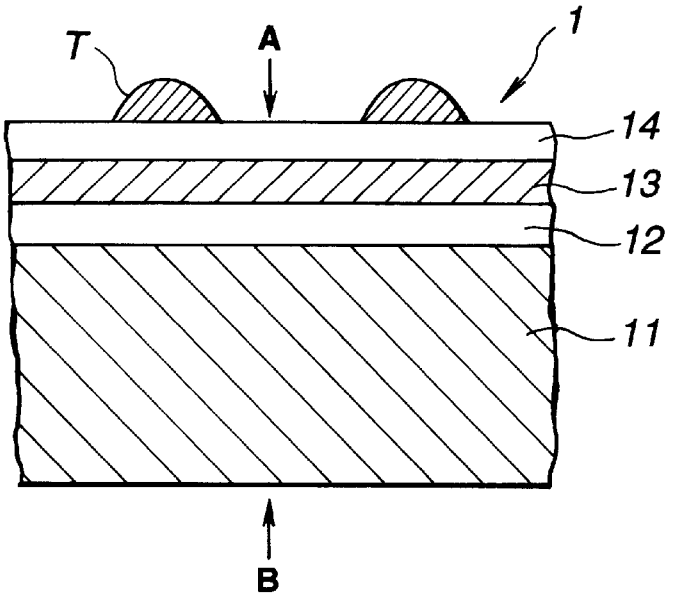
FIG. 1 is a schematic cross-sectional view illustrating a transfer-image transfer material used in the present invention.

FIG. 1 is a schematic cross-sectional view illustrating the configuration of layers of an electrophotographic transfer-image transfer material 1 used in the present invention. In FIG. 1, reference numeral 11 represents a base material on which the transfer material 1 is coated. Medium-quality or high-quality ordinary paper, coated paper obtained by coating a filling resin on one surface or both surfaces of the above-described paper, or a heat-resistant film made of polyethylene terephthalate (PET) or the like is used as the base material 11. In the case of paper, the weight of the paper is preferably at least 30 g/m$^2$, and more preferably, at least 45 g/m$^2$. In paper having a weight of less than 30 g/m$^2$, it is difficult to maintain the conveyability in an electrophotographic apparatus even if the thickness of the coated resin is increased. The weight of the paper is preferably equal to or less than 200 g/m$^2$, and more preferably, equal to or less than 150 g/m$^2$. If the weight exceeds 200 g/m$^2$, the rigidity of the paper becomes too high, thereby tending to result in a failure in the paper conveyability. In order to maintain an excellent image transfer property in an electrophotographic apparatus, 0.2–4 weight % of inorganic salt, such as sodium chloride or the like, is contained in the paper, and it is preferable that the volume resistivity of the paper is adjusted to $10^9$–$10^{14}$ Ω·cm when the paper is left in an environment of 20° C. and 65% RH for 24 hours. When using a film material as the base material 11, also, from the viewpoint of the paper conveyability, in the case of a biaxial-oriented heat-resistant PET film, the thickess of the film is preferably at least 50 μm, and more preferably, between 75 μm and 150 μm. It is preferable that such a film has an antistatic layer comprising a cationic or anionic surface-active agent on a surface B shown in FIG. 1, and the surface resistivity of the film is adjusted to $10^8$–$10^{12}$ Ω/□ (at 20° C. and 65% RH).

An adhesive layer 12 is provided in order to prevent a releasing layer 13 and a transfer layer 14 coated thereon from easily peeling within an electrophotographic apparatus. An aqueous acrylic emulsion, a water-soluble acrylic resin, water-soluble polyester, 6. 6 nylon, polyacrylonitrile or the like may be used as the material for the adhesive layer 12. When the base material 11 comprises paper, all of the above-described materials may be used. However, when the base material 11 comprises a resin film, such as PET or the like, it is necessary to select an appropriate material in order to provide a sufficient adhesive force depending on the base material 11. In the case of using PET or the like, water-soluble polyester is preferable, and preferably of a type such that ammonium chloride is added while forming a coated film and the water resisting property is improved after drying the coated film.

The releasing layer 13 mainly comprises polyvinyl alcohol obtained by saponifying polyvinyl acetate, and the degree of saponification of the polyvinyl alcohol is preferably at least 90%. When using polyvinyl alcohol having a degree of saponification of less than 90%, it is also possible to mix a small amount of water-soluble silicone resin as a releasing agent. However, it is difficult to use polyvinyl alcohol having a degree of saponification less than 60% from the viewpoint of the water resisting property.

Selection of materials for the releasing layer 13 and the adhesive layer 12 is also influenced by the adhesive force between the materials. In order to prevent peeling at least by the conveying force in an electrophotographic apparatus, the bonding strength between the materials is preferably at least 1.5 g/cm for peeling of 90°, and is preferably 4 g/cm in order to prevent rupture in the film when peeling the retransfer film layer comprising the transfer layer 14 and the releasing layer 13 from the base material 11.

The transfer layer 14 is required to have the property of receiving a toner image T in an electrophotographic apparatus, to hold the toner image T at least until the image retransfer process by heating starts, and to have a sufficient toner peeling property during the retransfer process. The transfer layer 14 is also required to have a better water resisting property than in the conventional approach. That is, it is necessary that the transfer layer 14 has an excellent water resisting property while maintaining permeability for a solvent during image retransfer. More specifically, the transfer layer 14 is formed by mixing polyvinyl alcohol obtained by saponifying polyvinyl acetate to a degree of at least 90% with polyvinyl alcohol obtained by saponifying polyvinyl acetate to a degree equal to or less than 90%. The percentage content of the solid component of polyvinyl alcohol saponified by at least 95% is preferably at least 10 weight %, and more preferably at least 25 weight %. If the percentage content is less than 10 weight %, the water soluble property which is a feature of polyvinyl alcohol having a low degree of saponification equal to or less than 90% becomes pronounced, so that disolution of the surface layer occurs in a high-temperature environment, and there is the possibility of contaminating the inside of an electrophotographic apparatus. When the percentage content of polyvinyl alcohol having a high degree of saponification exceeds 75 weight %, the regularity in the arrangement of direct-chain polymers forming the film increases as a cellulose film, so that there is the possibility that the amount of contraction of the film caused by a change in the amount of moisture in air increases. That is, the percentage content of the solid component of polyvinyl alcohol having a high degree of saponification is more preferably 25–75 weight %. An inorganic white pigment, such as silica power or the like, may be added to the transfer layer 14 in order to secure the electrophotographic transfer property.

The adhesive layer 12 is preferably thin in order to prevent separation by peeling, i.e., 2–10 μm. If the thickness of the adhesive layer 12 is less than 2 μm, unevenness in the thickness tends to occur. If the thickness exceeds 10 μm, peeling within the layer tends to occur.

The releasing layer 13 has the role of a primer layer as well as the role of achieving sufficient peeling at an interface between this layer and the adhesive layer 12, and preferably has a thickness of 2–6 μm. If the thickness exceeds 6 μm, contraction due to moisture within the this layer becomes pronounced, thereby tending to produce curling. If the thickness is less than 2 μm, unevenness in the thickness tends to occur.

The thickness of the transfer layer 14 is preferably at least 10 μm. If the thickness is less than 10 μm, an insufficient strength causing, for example, rupture of the film when it is peeled from the base material 11. The thickness of the transfer layer 14 is preferably equal to or less than 50 μm. If the thickness exceeds 50 μm, the film after peeling is hard, thereby tending to decrease the ability to follow a curved surface during image retransfer.

Next, electrophotographic toner applicable to the transfer-image transfer material used in the present invention will be described in detail. Basically, electrophotographic toner including a binder resin, which mainly comprises a resin, such as a styrene-acrylic resin copolymer, a styrene-butadiene copolymer, an epoxy resin, polyester or the like, and a dye/pigment having a color of yellow, cyan, magenta or the like as well as carbon black may be used to form a color image. Particularly, the following color toner can more effectively provide the effects of the color-image forming method of the present invention.

It is necessary that the toner particles for an electrophotographic apparatus have excellent melting property and color mixing property when applying heat, so that the toner preferably has a low softening point and a sharp melting property with a short melting time.

By using a sharp-melting toner, it is possible to widen the range of color reproduction of a copy, and to excellently obtain a color copy faithful to a multicolor image of an original.

Such a sharp-melting toner is manufactured, for example, by melting and mixing a binder resin, such as a polyester resin or a styrene-acrylic resin, a coloring agent (a dye, a subliming dye), a charge controlling agent, and the like, and pulverizing and classifying the mixture. If necessary, a process of adding various kinds of external additive agents to the toner may be added.

In consideration of the fixability and the sharp-melting property, it is preferable that the color toner uses a polyester resin as the binder resin. A sharp-melting polyester resin is a polymer compound having ester bonds at main chains of molecules synthesized from a diol compound and dicarbonic acid. Particularly, a polyester resin having a diol component comprising a bisphenol derivative or a substitient thereof expressed by the following formula:

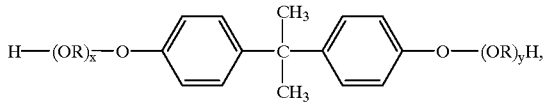

where R is a ethylene or propylene group, x and y are positive integers equal to or greater than 1, and the mean value of x+y is 2–10, and obtained by performing at least copolycondensation with a carboxylic-acid component comprising carboxylic acid having a valence number of at least 2, or acid anhydride thereof, or a lower alkyl ester thereof (for example, fumaric acid, maleic acid, maleic anhydride, phthalic acid, terephthalic acid, trimellitic acid, pyromellitic acid or the like) is more preferable since such a substance has a sharp-melting property.

Figure 2:
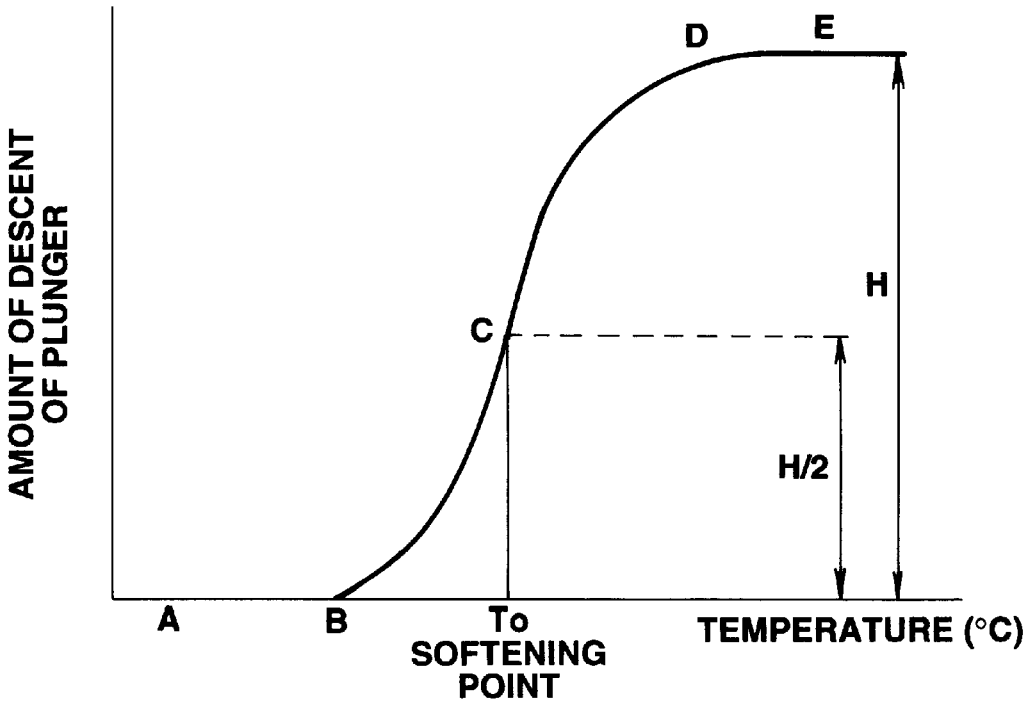
FIG. 2 is a graph illustrating a melting property of a toner which is preferably used in the present invention.

The softening point of a sharp-melting polyester resin is preferably 60–120° C. FIG. 2 shows the property of a softening point of a toner including such a sharp-melting polyester resin as the binder resin.

Using a flow tester of a type CFT-500 (made by Shimadzu Corporation), the curve of the amount of descent of a plunger as a function of temperature (hereinafter termed a "softening S curve") for the toner depicted when the toner is extruded through a die (nozzle) having a diameter of 0.5 mm and a thickness of 1.0 mm by applying a load of 50 kg while the temperature is raised at a constant rate of 5° C./min with an initial set temperature of 80° C. after a preheating time of 300 seconds is obtained. The toner comprises fine particles accurately weighed to 1–3 g, and the plunger has a cross section of 10 $cm^2$. A softening S curve as shown in FIG. 2 is obtained. As the temperature is raised at a constant rate, the toner is gradully heated and starts to flow (the plunger descends from A to B). As the temperature is further raised, the melted toner greatly flows out (B→C→D), and finally the descent of the plunger stops (D→E).

The height H of the S curve indicates the total amount of flow, and a temperature $T_0$ corresponding to a point C at a height of H/2 indicates the softening point of the toner.

Such a toner or resin having a sharp-melting property satisfies the following condition:

$$T_1=90\sim150^\circ\ C.,|\Delta T|=|T_1-T_2|=5\sim30^\circ\ C.,$$

where $T_1$ and $T_2$ are temperatures when the melt viscosity has values of $10^5$ cps and $5\times10^4$ cps, respectively.

A sharp-melting toner or resin having such a temperature-melt viscosity characteristic has the feature that the viscosity very sharply decreases when being heated. Such a decrease in the viscosity causes appropriate mixture between the uppermost toner layer and the lowermost toner layer, to abruptly increase in the transparency of the toner layer and cause excellent subtractive color mixture.

Next, the resin used in the transfer medium according to the present invention will be described in detail. It is necessary that the resin has the same or substantially the same surface tension as the toner for forming a color image. The surface tension which is substantially the same as the surface tension of the toner indicates that the toner tends to adhere to the resin on the surface of the transfer material from the theory of wetting and adhesion of the surface (by Zisman).

For example, when using a polyester resin as the binding resin of the toner, the surface tension is 20 dynes/cm. As the resin used on the surface facing the transfer material, for example, a resin which can be cured at room temperature or by being heated, selected from polyester resins, polytrifluoroethylene resins, polyvinyl fluoride resins, acrylic resins, epoxy resins, silicone resins, fluororesins and the like having a surface tension of 20±10 dynes/cm may be used.

Although the thickness of the resin layer provided so as to face the transfer material depends on the particle size of the toner, the thickness is preferably ½ of the particle size of the toner in order to transfer the toner particles on the image. If the thickness is less than this value, it is difficult to transfer the toner. On the other hand, if the thickness exceeds three times the particle size of the toner, the transfer material, the toner and the resin layer tend to be separated from one another.

In the present invention, the average particle size of the toner is measured according to the following method.

A Coulter counter of a type TA-II (made by Coulter Corporation) is used as a measuring apparatus, and is connected to an interface (made by Nikkaki Kabushiki Kaisha) and a personal computer of a type CX-1 (made by Canon Inc.) for outputting an indivudual distribution, a volume distribution, a mean value of the number of particles, and a mean value of volumes. An aqueous solution of 1% of NaCl is prepared as an electrolytic solution using a first-grade sodium chloride.

0.1–5 ml of a surface active agent, preferably an alkylbenzene sulfonate, is added to 100–150 ml of the electrolytic solution as a dispersing agent, and 0.5–50 mg, preferably 2–20 mg, of a sample to be measured is added to the obtained solution.

The electrolytic solution in which the sample is suspended is subjected to dispersion processing for about 1–3 minutes using an ultrasonic dispersion apparatus. The volume average particle size is obtained by measuring the particle size distribution of particles having particle sizes of 2–40 μm using the Coulter counter TA-II having an aperture of 100 μm.

The resin layer having the substantially same surface tension as the toner used in the present invention is formed by dissolving a resin for forming the resin layer in a volatile organic solvent comprising an alcohol, such as methanol, ethanol or the like, or a ketone, such as methyl ethyl ketone, acetone or the like, coating the obtained solution on the transfer medium to an optimum thickess according to a bar coating method, a dipping method, a spray coating method, a spin coating method or the like, depending on the shape of the transfer medium, and drying the coated layer.

EXAMPLE 1

A solution obtained by dissolving a sharp-melting polyester resin (having a surface tension of about 20 dynes/cm) having a softening point, defined by the point C on the softening S curve obtained by the flow tester of a type CFT-500 (made by Shimadzu Corporation), of 110° C. in acetone was coated on a glossy surface of a domestic tile (made by INAX Corporation) according to spray coating so that a resin layer 10 μm thick after being dried was obtained.

Then, an image was output onto the transfer layer 14 of the transfer-image transfer material 1 shown in FIG. 1 using an electrophotographic apparatus CLC 700 made by Canon Inc., and the formed image was developed. The transfer layer 14 having toner particles (having an average particle size of 8 μm, and a surface tension of a binding resin of 20 dynes/cm), and the releasing layer 13 provided so as to be easily peeled from the adhesive layer 12 were peeled off from the base material 11, and the combined film comprising the transfer layer 14 and adhesive layer 12 was placed on the transfer layer side of a transfer object (transfer medium) so that the surface having the toner image T was placed downward. Hot pressing was performed from above at about 100° C. for 10 seconds. At that time, in order to prevent air from entering between the tile and the polyvinyl-alcohol layer, air on the surface is removed by rubbing the surface with Silbon paper or the like. This operation is repeated two or three times. After terminating these operations, the transfer layer 14 is softened by a mixed solution of about 20% of water and about 80% of alcohol. As a result, the toner image T was almost completely transferred onto the tile, serving as the transfer medium, to provide a sufficiently excellent image.

The thickess and the material of each layer of the transfer-image transfer material 1 used are as follows.

| Layer | Thickness | Material used |
|---|---|---|
| Base material | 110 μm | Coated paper having a weighing of 104 g/m$^2$ |
| Adhesive layer | 5 μm | Acrylic resin (Product name: Cover coat resin LO-316 made by Goou kagaku Kabushiki Kaisha) |
| Releasing | 5 μm | Polyvinyl alcohol (Product name: Kraray Poval PVA 110 made by Kraray Co., Ltd. surface tension: 37 dynes/cm) |
| Transfer | 10 μm | Polyvinyl alcohol (Product name: Kraray Poval PVA 110 Antistatic agent (Product name: Catiogen L made by Daiichi Seiyaku Co., Ltd. contained by 2 weight parts with respect to 100 weight parts of polyvinyl alcohol) |

The surface tension of the resin layer is a value before the toner image is transferred.

The surface tension of each of the resin layer, the binding resin of the toner, and the transfer layer was measured using numbered wetting-index reference solutions (made by Daikin Finechemical Kabushiki Kaisha). That is, a resin to be measured was formed in the shape of a sheet, a droplet of a wetting-index reference solution was dropped onto the sheet using a pipette, and the contact angle (θ) of a droplet was measured. This operation was performed in the order of a wetting-index reference solution having a smaller number; that is, the order of smaller surface tension, and the result was plotted with the value of the surface tension of the wetting-index reference solution being the transverse axis and cos θ being the longitudinal axis. A graph of a straight line extending diagonally down from the longitudinal axis toward the transverse axis was obtained. From this straight line graph, the value when θ=0; that is the value of the surface tension of the wetting-index reference solution when cos θ=1 was read and is the value of the surface tension of the resin.

COMPARATIVE EXAMPLE 1

Image retransfer was performed in the same manner as in Example 1, except that the resin layer was not formed on the tile, serving as the transfer medium. Only 50% of the toner was transferred onto the transfer medium. Furthermore, the toner transferred onto the transfer medium soon peeled.

EXAMPLE 2

Image retransfer was performed in the same manner as in Example 1, except that a layer of a polytrifluorothene resin (having a surface tension of 22 dynes/cm) was formed on the surface of the transfer medium. In this example, the toner image was almost completely transferred onto the tile, serving as the transfer medium, and a sufficiently excellent image was obtained.

COMPARATIVE EXAMPLE 2

Image retransfer was performed in the same manner as in Example 1, except that a layer of a polyethylene terephthalate resin (having a surface tension of 43 dynes/cm) was formed on the surface of the transfer medium. Only 80% of the toner was transferred.

EXAMPLE 3

Image retransfer was performed in the same manner as in Example 1, except that a layer of a styrene-acrylic resin (having a surface tension of 30 dynes/cm) was formed on the surface of the transfer material, and that a styrene acrylic resin (having a surface tension of 30 dynes/cm) was used as the binding resin of the toner. In this example, the toner image T was almost completely transferred onto the tile, serving as the transfer medium, and a sufficiently excellent image was obtained.

COMPARATIVE EXAMPLE 3

Image retransfer was performed in the same manner as in Example 3, except that a layer of a polyhexamethylene adipamide resin (having a surface tension of 46 dynes/cm) was formed on the surface of the transfer medium. Only 80% of the toner was transferred onto the transfer medium.

TABLE 1

| | Example | | | Comparative Example | | |
|---|---|---|---|---|---|---|
| | 1 | 2 | 3 | 1 | 2 | 3 |
| Surface tension of the toner | 20 | 20 | 30 | 20 | 20 | 20 |
| Surface tension of the surface of the transfer material | 20 | 22 | 30 | NA | 43 | 46 |
| Retransfer property | A | A | A | C | B | B |

A Image transfer of almost 100%
B Image transfer of about 80%, but image retransfer is insufficient at halftone portions
C Image transfer of only about 50%

EXAMPLE 4

Image retransfer was performed in the same manner as in Example 1, except that a layer of a polyvinylidene chloride resin (having a surface tension of 40 dynes/cm) was formed on the surface of the transer medium, and that a styrene acrylic resin (having a surface tension of 30 dynes/cm) was used as the biding resin of the toner. In this example, the toner image T was almost completely transferred onto the tile, serving as the transfer medium, and a sufficiently excellent image was obtained.

EXAMPLE 5

Image retransfer was performed in the same manner as in Example 1, except that a layer of a polyester resin (having a surface tension of 20 dynes/cm) was formed on the surface of the transfer medium, and that a styrene acrylic resin (having a surface tension of 30 dynes/cm) was used as the biding resin of the toner. In this example, the toner image T was almost completely transferred onto the tile, serving as the transfer medium, and a sufficiently excellent image was obtained.

The individual components shown in outline in the drawings are all well-known in the color-image forming method arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image retransfer method comprising:

(a) transferring a toner image to a transfer material, said transfer material comprising a polyvinyl alcohol layer formed on a supporting member;

(b) fixing said transferred toner image; and (c) retransferring the transferred toner image onto a transfer medium, said transfer medium having on a surface thereof a resin layer having a surface tension and a binding resin of a toner forming said toner image, said binding resin of a toner having a surface tension, wherein a difference between the surface tension of the binding resin of the toner and the surface tension of the resin layer is less than 10 dynes/cm.

2. A method according to claim 1, wherein a resin forming the resin layer is transparent or white.

3. A method according to claim 1, wherein the resin layer has a thickness equal to or more than half and equal to or less than three times an average particle size of the toner.

4. A method according to claim 1, wherein a resin forming the resin layer comprises a curable resin.

5. A method according to claim 4, wherein said curable resin comprises a resin selected from the group consisting of polyester resins, polytrifluoroethylene resins, polyvinyl fluoride resins, acrylic resins, epoxy resins, and fluororesins.

6. A method according to claim 1, wherein said polyvinyl-alcohol layer comprises a releasing layer and a transfer layer.

7. A method according to claim 6, wherein said releasing layer has a thickness of 2–6 $\mu$m.

8. A method according to claim 6, wherein said transfer layer has a thickness of 10–50 $\mu$m.

9. A method according to any one of claims 1–8, wherein said image is a color image.

* * * * *